US006431621B1

(12) United States Patent
De Groot

(10) Patent No.: US 6,431,621 B1
(45) Date of Patent: Aug. 13, 2002

(54) SECURING DEVICE

(76) Inventor: Cornelius De Groot, 20 Millport Drive, Warwick, Western Australia, 6024 (AU)

( * ) Notice: Subject to any disclaimer, the term of this patent is extended or adjusted under 35 U.S.C. 154(b) by 0 days.

(21) Appl. No.: 09/542,755

(22) Filed: Apr. 4, 2000

(30) Foreign Application Priority Data

| | | |
|---|---|---|
| Apr. 6, 1999 | (AU) | PP 9578 |
| Apr. 9, 1999 | (AU) | PP 9654 |
| May 14, 1999 | (AU) | PQ 0356 |
| Nov. 22, 1999 | (AU) | PQ 4164 |
| Dec. 22, 1999 | (AU) | PQ 4789 |

(51) Int. Cl.[7] ..... E05B 17/00

(52) U.S. Cl. ..... 292/346; 292/DIG. 17; 292/DIG. 41; 292/138; 70/131

(58) Field of Search ..... 292/332, 336, 292/223, 196, 262, 278, 292, 298, 346, DIG. 9, DIG. 17, DIG. 44, 138, 139; 70/131

(56) References Cited

U.S. PATENT DOCUMENTS

| | | | | |
|---|---|---|---|---|
| 946,141 | A | * | 1/1910 | Krier |
| 1,589,149 | A | * | 6/1926 | Hanle |
| 2,794,665 | A | * | 6/1957 | Sasse |
| 3,810,667 | A | * | 5/1974 | Dugan |
| 3,811,150 | A | * | 5/1974 | Chalmers |
| 4,564,229 | A | * | 1/1986 | Mullich et al. |
| 5,570,917 | A | * | 11/1996 | Cutrer |
| 5,752,728 | A | * | 5/1998 | Matouschek |

FOREIGN PATENT DOCUMENTS

| | | | |
|---|---|---|---|
| GB | 2088462 A | * | 6/1982 |
| GB | 2134960 A | * | 8/1984 |
| GB | 2178095 A | * | 2/1987 |

* cited by examiner

*Primary Examiner*—Anthony Knight
*Assistant Examiner*—Vishal Patel
(74) *Attorney, Agent, or Firm*—Howard & Howard

(57) ABSTRACT

A securing device for securing a door panel and a complementary door frame housing a latch means in a closed configuration against forced entry. The securing device includes receiving means mounted on the length of the door frame and an engaging means mounted on the length of the door panel, wherein a portion of the engaging means is pivotable between a first configuration and a second configuration. In the second configuration the portion of the pivotable engaging means is nested within the receiving means thereby preventing the door from being forced open. The engaging means is moved between the first and second configurations by a latch engaging means which interconnects the pivotable portion of the engaging means with the latch.

14 Claims, 6 Drawing Sheets

SECURING DEVICE

Figure 1:
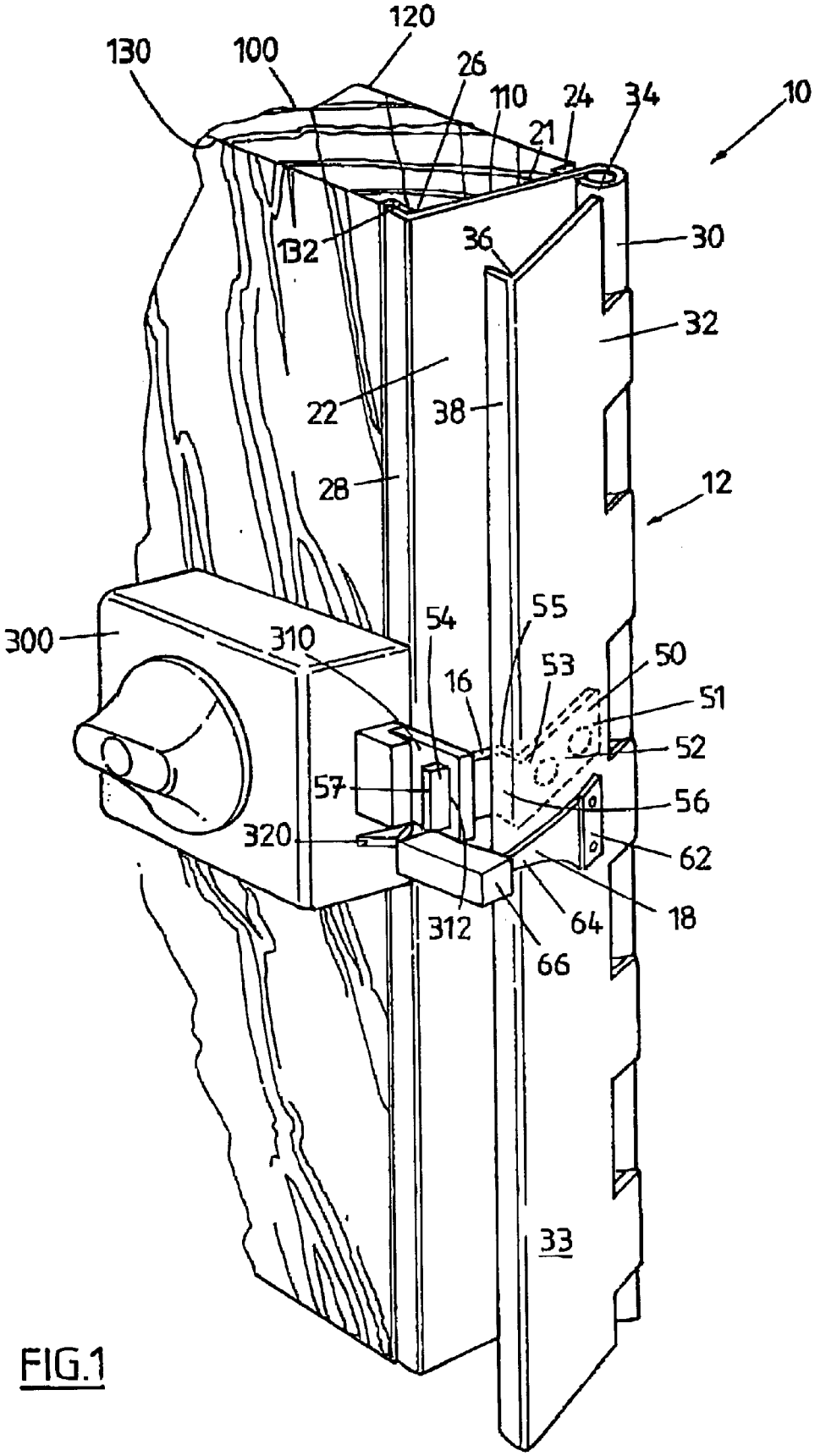

The present invention relates to a securing device, in particular for securing inwardly or outwardly swingable doors or windows in a single or double door assembly. It is common to provide a securing device for securing inwardly or outwardly swingable doors or windows which includes a lock-, bolt-, or latch-mechanism mounted on a door or a window panel, and a keeper or strike plate mounted on a corresponding door or window frame, wherein the door or window is held shut by engagement of the mechanism with the keeper or strike plate. Typically, at least one securing device is disposed, in use, on respective mating edges of the panel and the corresponding frame.

While such securing devices are satisfactory in preventing unforced entry through the door or window, such devices are vulnerable to removal either from the frame or the panel when placed under a concentrated loading.

United Kingdom Patent Number 2233701 describes a door locking arrangement for an inwardly opening hinged door. The door locking arrangement comprises a locking flap which extends substantially the full length of the edge of the door and is hinged to the door frame. It is movable between a position where it traps the edge of the door to prevent its opening and a retracted position where the locking flap is flush with the door frame. The locking flap may be moved between both positions manually or by an electrical drive means.

Although the arrangement provides greater resistance to forced entry on a door, prolonged use of the arrangement will effect wear on the edge of the door panel and an increased likelihood of slippage between the panel and the locking flap if the panel is placed under stress.

It is also interesting to note that as the locking flap travels through its arc of movement to the retracted position, the leading edge of the locking flap is effectively closer to the door panel edge. In order to allow for this effect, there is a requirement for an increased spatial clearance between the door panel and the frame itself The increased clearance has the disadvantage that the door assembly becomes quite noisy—the door rattling within the frame. It will also be appreciated that an increased clearance compensates for warping and lowing occurring in the door and/or frame due to temperature and humidity differentials.

United Kingdom Patent Number 2166795 describes a latching mechanism for a hinged fire door. The latching mechanism comprises a hinged leaf which extends along substantially all of the closing side of the door, and is arranged to engage with an abutting lip of the door frame. The hinged leaf is positioned in a retracted position, to permit the door to be swung open on its hinge, by turning the door handle which is in connective communication with the hinged leaf The latching mechanism is appropriate for inwardly opening fire doors for which strong steel frames are provided. However, a secure latching arrangement for outwardly opening doors and double doors has not been addressed by the prior art. Furthermore, most conventional domestic inwardly opening doors are provided with wooden door frames and door panels, with a secondary latching mechanism for enhanced security, such as a dead latch, in addition to the primary latching mechanism. The implementation of the abutting lip on the frame described in GB2166795 will require extensive rebating to accommodate the door panel and thus increased labour and expense when fitted to a domestic door frame. The clearance between the door panel and the frame also accommodates the potential for the door to warp, bow or expand under extreme temperatures, for instance, in case of fire. Furthermore, the invention described in GB2166795 does not account for the operation of the secondary latching mechanism found on most conventional domestic doors.

The present invention seeks, among other things, to overcome at least some of the above mentioned disadvantages.

In accordance with one aspect of the present invention there is provided a securing device for securing a panel and a complementary frame housing a latch means in a closed configuration against forced entry, comprising an engaging means configurable in a first configuration in which the panel and the frame are in an unsecured configuration and a second configuration in which the panel and the frame are in a secured configuration, a receiving means for receiving the engaging means in the second configuration, and means for connecting the engaging means to the latch means to enable the engaging means to be moved between the first and second configurations.

Figure 2:
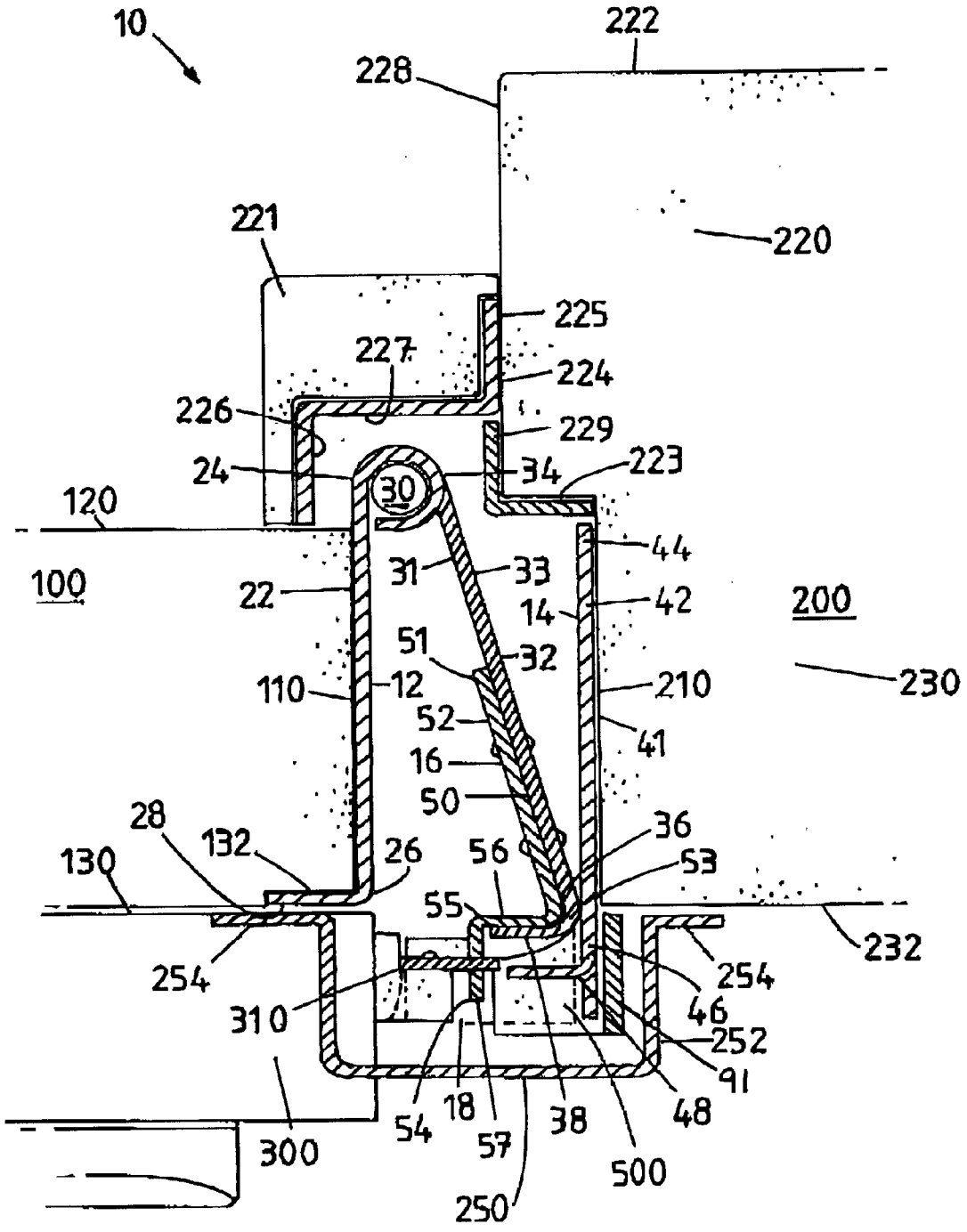
Figure 3:
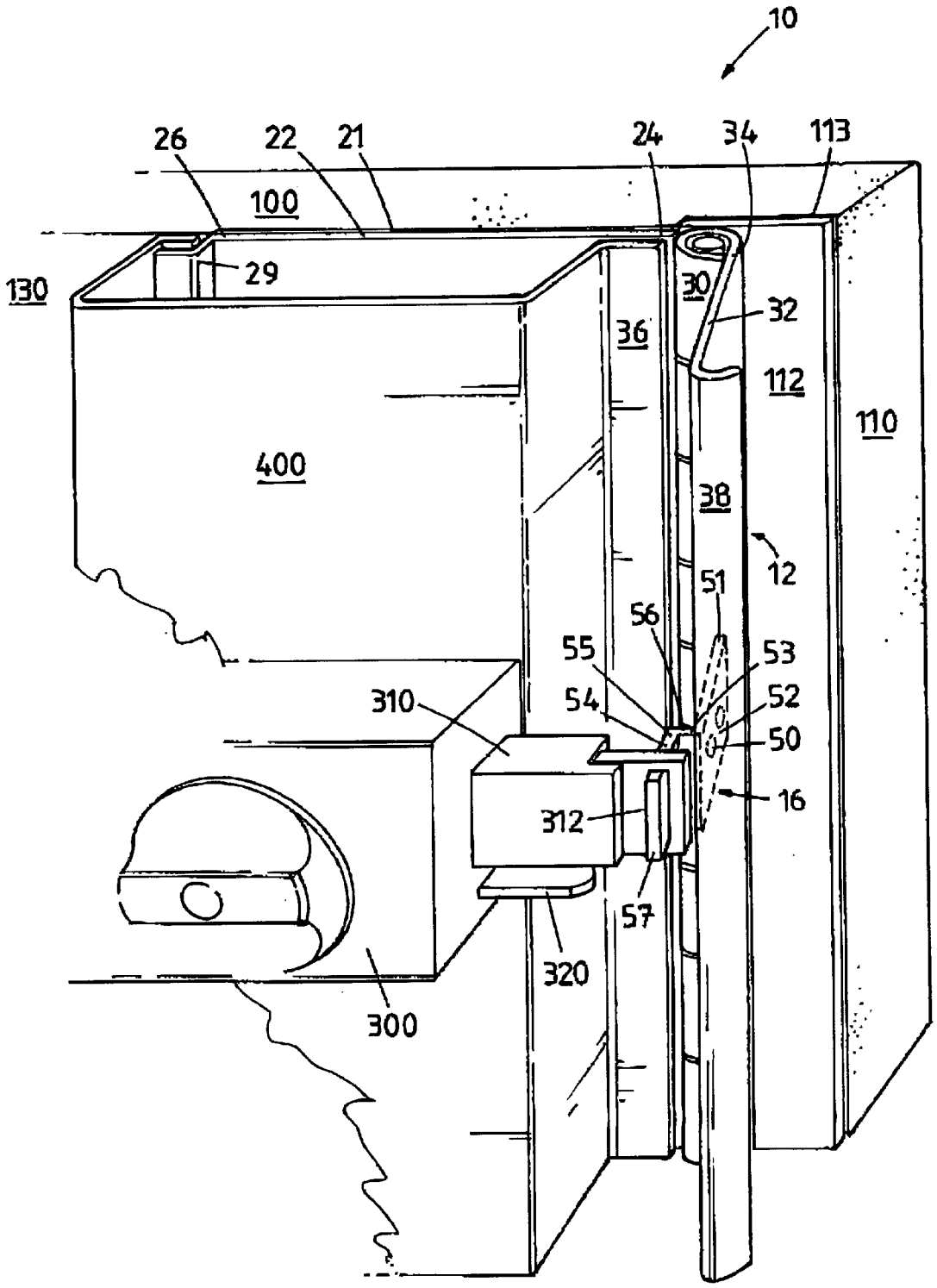
Figure 4:
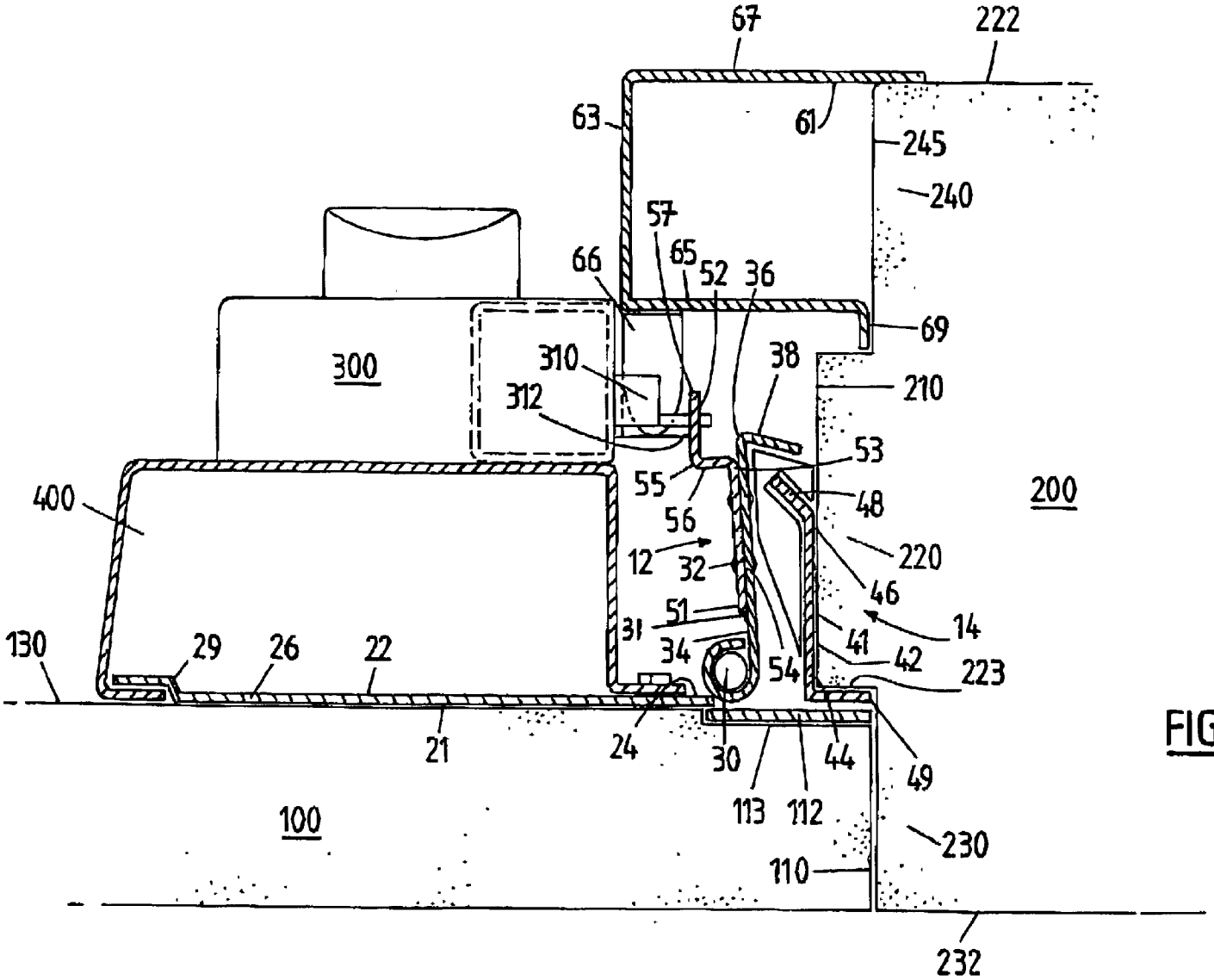
Figure 5:
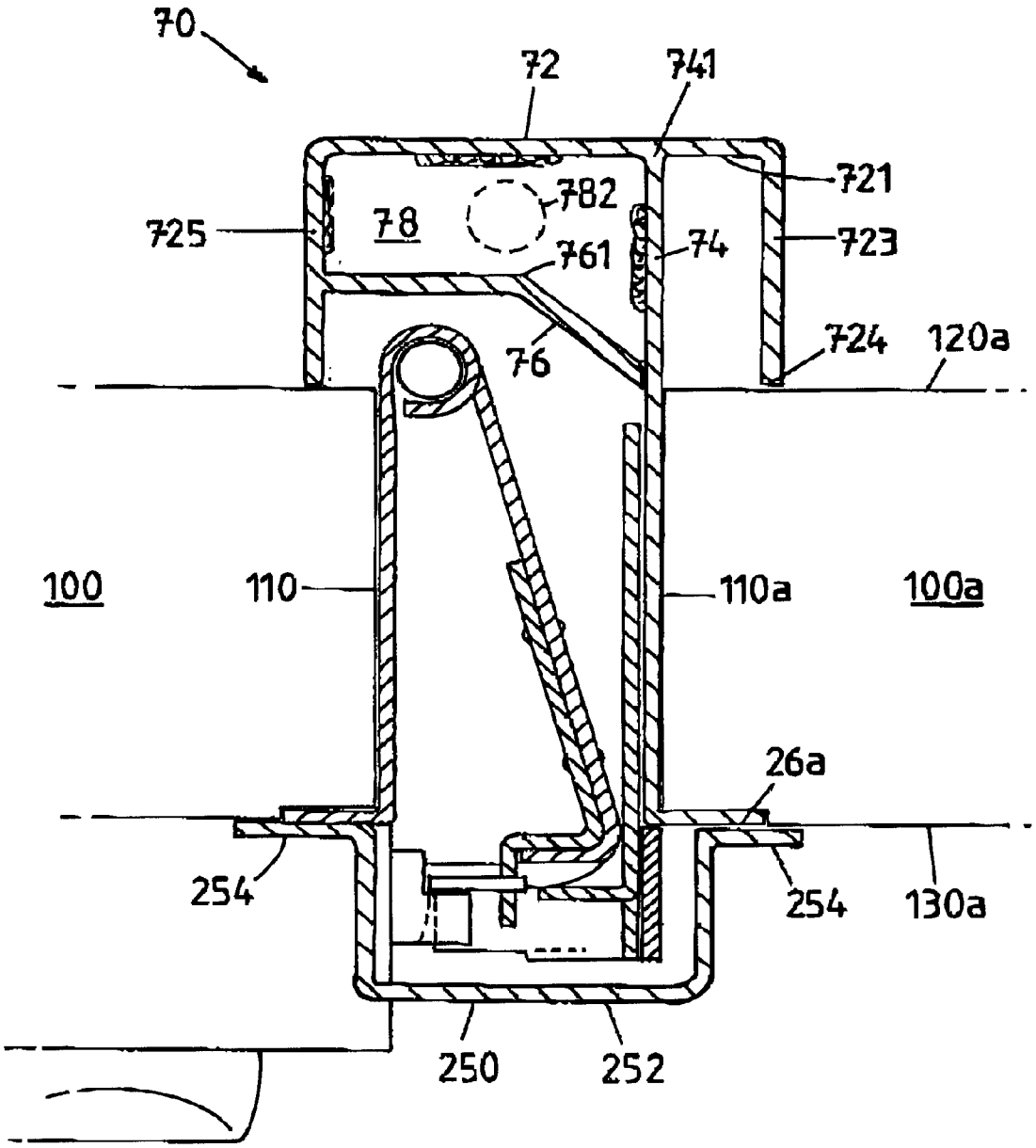
Figure 6:
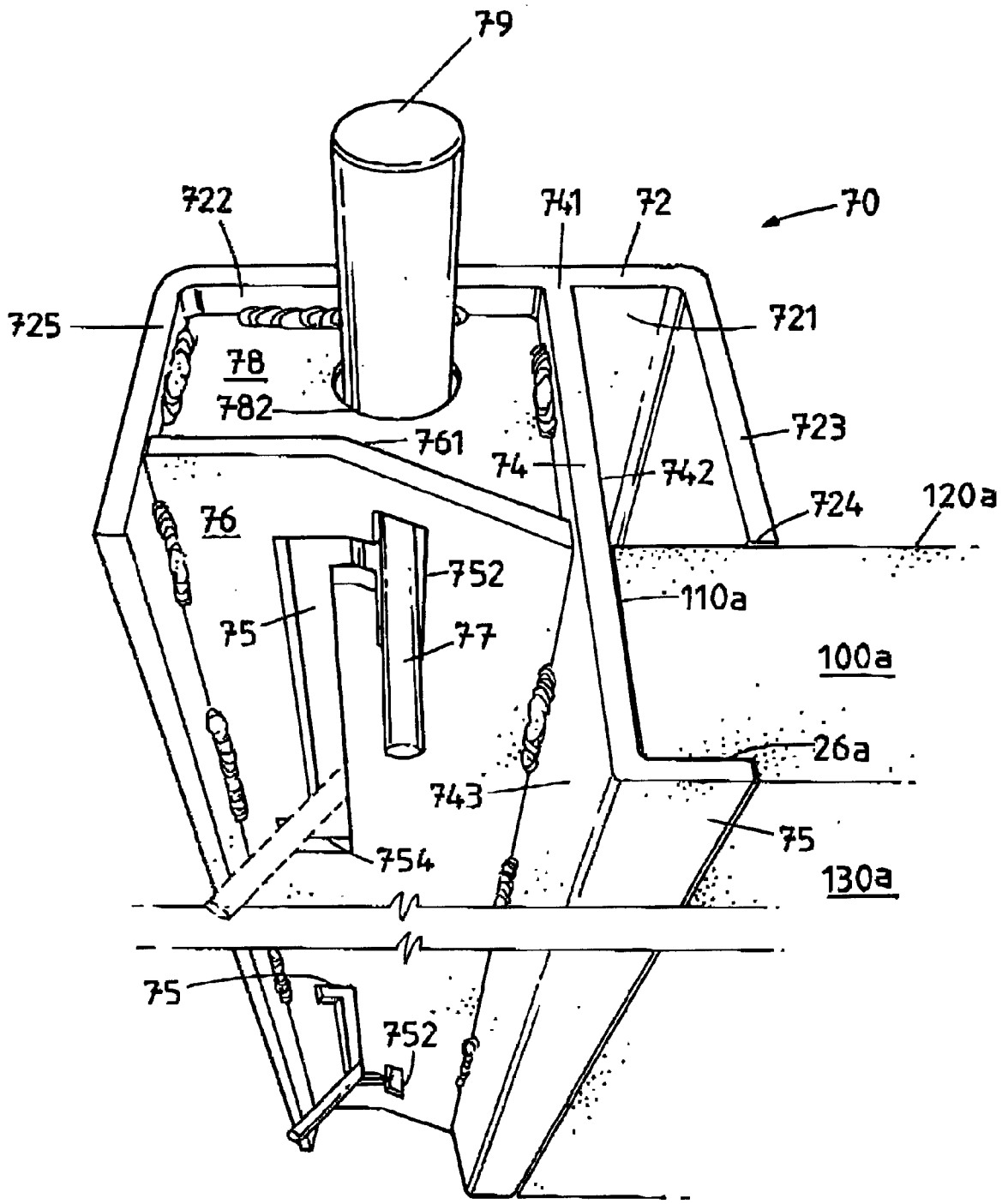

The present invention will now be described, by way of example only, with reference to the accompanying drawings, in which:

FIG. 1 is a perspective view of an engaging means and a latch engaging means of the securing device mounted on an inwardly opening door panel in accordance with the present invention, wherein the door panel is in an unsecured configuration, FIG. 2 is a sectional view of the engaging means and the latch engaging means of the securing device mounted on the inwardly opening door panel shown in FIG. 1 and a receiving means mounted on the door frame in accordance with the present invention, wherein the panel and the frame are in a secured configuration;

FIG. 3 is a perspective view of an engaging means and a latch engaging means of the securing device mounted on an outwardly opening door panel in accordance with the present invention, wherein the door panel is in an unsecured configuration, and FIG. 4 is a sectional view of the engaging means and the latch engaging means of the securing device mounted on the outwardly opening door panel shown in FIG. 3 and a receiving means mounted on the door frame in accordance with the present invention, wherein the panel and the frame are in a secured configuration;

FIG. 5 is a sectional view of the engaging means, the latch engaging means of the securing device, and a mounting device arranged for use with a pair of inwardly opening double doors in accordance with the present invention, wherein the doors are in a secured configuration, and FIG. 6 is a perspective view of the mounting device shown in FIG. 5

Referring to FIGS. 1 and 2 of the drawings, there is shown a securing device 10, for use with an inwardly opening door, which includes an engaging means 12, a receiving means 14, a latch engaging means 16 and a dead-latch engaging means 18. The engaging means 12 includes a first elongate strip 22 having a first side 24 and a second side 26, and a second elongate strip 32 having a first side 34 and a second side 36. The first side 24 of the first elongate strip 22 is hingedly connected to the first side 34 of the second elongate strip 32 by a hinge portion 30. The second side 26 of the first elongate strip 22 is provided with a flange portion 28. Likewise, the second side 36 of the second elongate strip 32 is provided with a flange portion 38 The flange portions 28, 38 extend rearwardly of the hinge portion 30. It is within the scope of the present invention that the first elongate strip 22 be pivotable about the second elongate strip 32, and it is envisaged that technical equivalents of the hinge portion 30 encompass a part hinge and a part knife edge pivot.

The engaging means 12 is arranged to be mounted on an inwardly swingable door panel 100 substantially along the whole length of the door panel 100. A first surface 21 of the first elongate strip 22 is mounted contiguously on a side surface 110 of the panel 100. The first side 24 of the first elongate strip 22 and the hinge portion 30 are disposed adjacent an outwardly facing surface 120 of the panel 100. The second side 26 of the first elongate strip 22 is disposed adjacent an inwardly facing surface 130 of the panel 100.

It is envisaged that the inner surface 130 of the door panel 100 will be provided with a recess 132 for receiving the flange portion 28 of the first elongate strip 22.

The second elongate strip 32 is pivotable about the hinge portion 30 between a first position wherein the second elongate strip 32 is in substantially parallel alignment with and spaced apart from the first elongate strip 22, and a second position wherein the second elongate strip 32 extends rearwardly from the hinge portion 30 at an acute angle from the first elongate strip 22.

The receiving means 14 includes an elongate strip 42 having a first side 44 and a second side 46. The second side 46 of the elongate strip 42 is provided with a flange portion 48.

The receiving means 14 is arranged to be mounted on a door frame 200 corresponding to the inwardly swingable door panel 100 substantially along the whole length of the door frame 200. The door frame 200 has a recessed portion 230 disposed proximal to an inwardly facing surface 232 of the frame 200, and a laterally protruding portion 220 disposed proximal to an outwardly facing surface 222 of the frame 200. The outwardly facing surface 120 of the door panel 100 is substantially in parallel alignment with an inwardly facing surface 223 of the laterally protruding portion 220 of the frame 200 when the panel 100 and the frame 200 are in a closed configuration. A first surface 41 of the elongate strip 42 is mounted contiguously on a first rebate surface 210 of the recessed portion 230 of the frame 200. The first side 44 of the elongate strip 42 is disposed adjacent the laterally protruding portion 220 of the frame 200. The second side 46 of the elongate strip A2 is disposed adjacent the inwardly facing surface 232 of the recessed portion 230, and it is mounted on a reinforcing strip 91. The flange portion 48 extends substantially parallel to the inwardly facing surface 232.

The latch engaging means 16 includes a stepped rectilinear member 50 comprising a first member 52 having a first end 51 and a second end 53, a second member 54 having a first end 55 and a second end 57 and a web member 56. The second end 53 of the first member 52 is endwise interconnected to the first end 55 of the second member 54 by the web member 56.

The latch engaging means 16 is arranged to be mounted on the engaging means 12 in substantially horizontal alignment with a latch means 300. As shown in FIGS. 1 and 2, the latch means 300 is mounted on the inwardly facing surface 130 of the door panel 100, adjacent the side surface 110 of the door panel 100. A portion of the latch means 300 overlays the flange portion 28 of the first elongate strip 22 of the engaging means 12.

The latch means 300 is provided with a latch 310 slidable between a first retracted position and a second extended position. The latch 310 is provided with an aperture 312.

The stepped rectilinear member 50 is disposed substantially perpendicularly to the second elongate strip 32. The first member 52 is mounted contiguously on a first surface 31 of the second elongate strip 32. The first end 51 of the first member 52 is disposed adjacent the hinge portion 30. The second end 53 of the first member 52 is disposed adjacent the second side 36 of the second elongate strip 32. The web member 56 overlays the flange portion 38 of the second elongate strip 32 to an extent that the second member 54 is spaced from and extends in substantially parallel alignment with the second elongate strip 32.

As shown in FIGS. 1 and 2, the second member 54 is arranged to be received in the aperture 312 in the latch 310 of the latch means 300. The arrangement of the latch engaging means 16, the latch means 300, and the engaging means 12 is such that the second elongate strip 32 of the engaging means 12 is positionable in the first position by sliding the latch 310 to the first retracted position, or the second position by sliding the latch 310 to the second extended position as shown in FIG. 2.

The dead-latch engaging means 18 includes a mounting plate 62, a substantially flat connection strip 64 and a striker 66. The connection strip 64 is hingedly connected at a first end to the mounting plate 62, and it is fixedly connected at a second end to the striker 66.

To avoid the need to develop a specific latching means 300 and thus allow the use of presently available lock assemblies, the invention encompasses a means of dead latch should self-engaging locks be used.

The dead-latch engaging means 18 is arranged to be mounted on the engaging means 12 in substantially horizontal alignment with a dead-latch 320 of the latch means 300. As shown in FIGS. 1 and 2, the mounting plate 62 is mounted contiguously on a second surface 33 of the second elongate strip 32. The connection strip 64 is disposed perpendicularly to the second elongate strip 32, wherein the striker 66 and the second end of the connection strip overhang the second side 36 of the second elongate strip 32.

It is evident from FIG. 2 that the door panel 100 is spaced apart from the recessed portion 230 of the door frame 200 when the door panel 100 and the door frame 200 are in a closed configuration. The engaging means 12, the receiving means 14, the latch engaging means 16, and the dead-latch engaging means 18 are disposed intermediate the door panel 100 and the door frame 200.

In order to prevent unauthorised access to the gap between the door frame 200 and the door panel 100, a plurality of flashing members are provided to cover and camoflage the gap. The laterally protruding portion 220 of the frame 200 is provided with a first elongate flashing member 224 of substantially Z-shaped profile. The first elongate flashing member 224 comprises a first portion 225 spaced apart from and substantially aligned parallel to a second portion 226, wherein the first and second portions 225, 226 are endwise interconnected with a web portion 227. The first portion 225 is mounted contiguously on a second rebate surface 228 of the protruding portion 220. The second portion 226 is disposed adjacent to and perpendicularly aligned with the outwardly facing surface 120 of the door panel 100, proximal the hinge portion 30 of the engaging means 12. The web portion 227 is spaced from and disposed in parallel alignment with the outwardly facing surface 120 of the door panel 100. In this way, the elongate flashing 224 camouflages a gap between the panel and the frame 100, 200 and provides a protective barrier against tampering with the receiving and engaging means.

The protruding portion 220 is also provided with a second elongate flashing member 229 of substantially L-shaped profile. The member 229 is mounted contiguously over a meeting edge and adjacent surfaces of the inwardly facing surface 223 and the second rebate surface 228 of the laterally protruding portion 220.

As shown in FIG. 2, the gap between the door panel 100 and the door frame 200 at the inwardly opening side is covered and camouflaged by a third elongate flashing member 250. The third elongate flashing member has a substantially C-shaped profile 252 with opposing outwardly extending flanges 254. One outwardly extending flange 254 is arranged, in use, to be mounted to the inwardly facing surface 130 of the door panel 100, whilst the opposing outwardly extending flange 254 is free. In the vicinity of the latch means 300 the third elongate flashing member 250 is provided with a cut-out section so as to fit snugly over the latch means 300.

Preferably, the first and second elongate flashing members 224, 229 are either filly or partially coated with tungsten. A tungsten coating protects the first and second elongate flashing members 224, 229 from damage by power drills directed through the frame 200 or other points of access.

As shown in FIG. 2, the first elongate flashing member 224 is also provided with a strip 221 complementary to the substantially Z-shaped profile of the member 224. The strip 221 is a cosmetic covering for the first member 224 and is preferably made of the same timber or material as the door frame 200 and the door panel 100.

Referring to FIGS. 3 and 4 of the drawings, there is shown a securing device 10, for use with an outwardly opening door, which includes an engaging means 12, a receiving means 14, a latch engaging means 16. It will be understood that like features will be referred to by like numbers.

The engaging means 12 includes a first elongate strip 22 having a first side 24 and a second side 26, and a second elongate strip 32 having a first side 34 and a second side 36. The first side 24 of the first elongate strip 22 is hingedly connected to the first side 34 of the second elongate strip by a hinge portion 30. The second side 36 of the second elongate strip 32 is provided with a flange portion 38. The flange portion 38 extends forwardly of the hinge portion 30. It is within the scope of the present invention that the first elongate strip 22 be pivotable about the second elongate strip 32, and it is envisaged: that technical equivalents of the hinge portion 30 encompass a part hinge and a part knife edge pivot. The second side 26 of the first elongate strip 22 is provided with a stepped portion 29. The stepped portion 29 extends outwardly from the first elongate strip 22.

The engaging means 12 is arranged to be mounted on an outwardly swingable door panel 100 substantially along the whole length of the door panel 200. A first surface 21 of the first elongate strip 22 is mounted contiguously on an inwardly facing surface 130 of the panel 100. The first side 24 of the first elongate strip 22 and the hinge portion 30 are disposed proximal to and spaced apart from a side surface 110 of the panel 100.

The second elongate strip 32 is pivotable about the hinge portion 30 between a first position wherein the second elongate strip 32 is inclined at a first obtuse angle towards the first elongate strip 22, and a second position wherein the second elongate strip 32 extends rearwardly of the hinge portion 30 and forms a second obtuse angle with the first elongate strip 22, the second obtuse angle being greater than the first obtuse angle The receiving means 14 includes an elongate strip 42 having a first side 44 and a second side 46. The second side 46 of the elongate strip 42 is provided with an inclined flange portion 48. The first side 44 of the elongate strip 42 is provided with a perpendicular flange portion 49. The perpendicular flange portion 49 extends in an opposing direction to the inclined flange portion 48.

The receiving means 14 is arranged to be mounted an a door frame 200 corresponding to the outwardly swingable door panel 100 substantially along the whole length of the door frame 200. The door frame 200 has a first recessed portion 230 disposed proximal to an outwardly facing surface 232 of the frame 200, a second recess portion 240 disposed proximal to an inwardly facing surface 222 of the frame 200, and a laterally protruding portion 220 disposed between the first and second recessed portions 230, 240. The inwardly facing surface 130 of the door panel 100 is in substantially parallel alignment with an outwardly facing surface 223 of the laterally protruding portion 220 of the frame 200 when the panel 100 and the frame 200 are in a closed configuration.

A first surface 41 of the elongate strip is mounted contiguously on a first rebate surface 210 of the laterally protruding portion 220 of the frame 200. The perpendicular flange portion 49 is mounted contiguously on the outwardly facing surface 223 of the laterally protruding portion 220 of the frame 200.

The latch engaging means 16 includes a stepped rectilinear member 50 comprising a first member 52 having a first end 51 and a second end 53, a second member 54 having a first end 55 and a second end 57 and a web member 56. The second end 53 of the first member 52 is endwise interconnected to the first end 55 of the second member 54 by the web member 56.

The latch engaging means 16 is arranged to be mounted on the engaging means 12 in substantially horizontal alignment with a latch means 300. As shown in FIGS. 3 and 4, the latch means 300 is mounted on a spacer strip 400 disposed on the inwardly facing surface 130 of the door panel 100 proximal to and spaced from the side surface 110 of the door panel 100. A portion of the spacer strip 400 overlays the first elongate strip 22 of the engaging means 12.

The latch means 300 is provided with a latch 310 slidable between a first retracted position and a second extended position. The latch is provided with an aperture 312. The stepped rectilinear member 50 is disposed perpendicularly to the second elongate strip 32. The first member 52 is mounted contiguously on a first surface 31 of the second elongate strip 32. The first end 51 of the first member 52 is disposed adjacent the hinge portion 30. The second end 53 of the first member 52 is disposed adjacent the second side 36 of the second elongate strip 32. The web member 56 extends substantially perpendicularly from the second elongate strip 32 such that the second member 54 is spaced from and extends in substantially parallel alignment with the second elongate strip 32. It is envisaged that the stepped rectilinear member 50 could be a curved member or a linear member, provided that it engages with an aperture 312 in the latch 310, its purpose being to connect the latch 310 to the second elongate strip 32.

As shown in FIGS. 3 and 4, the second member 54 is arranged to be received in the aperture 312 in the latch 310 of the latch means 300. The arrangement of the latch engaging means 16, the latch means 300, and the engaging means 12 is such that the second elongate strip 32 of the engaging means 12 is positionable in the first position by sliding the latch 310 to the first retracted position, or the second position by sliding the latch 310 to the second extended position as shown in FIG. 4.

The dead-latch engaging means 18 includes an elongate mounting strip 63 and a striker 66. The elongate mounting strip 63 has a substantially C-shaped profile with a first arm 65 being provided with an outwardly extending flange 69, and a second arm 67 having a longer length than the first arm 65.

The flange 69 is contiguously mounted on second rebate surface 245 of the second recessed portion 240 of the door frame 200. An end portion of an inner surface 61 of the second arm 67 is contiguously mounted on an inwardly facing surface 222 of the door frame 200.

The striker 66 is mounted on the first arm 65 remote from the flange 69. The striker 66 is arranged to be mounted in substantially horizontal alignment with a dead-latch 320 of the latch means 300.

A portion of the inwardly facing surface 130 of the panel 100 disposed adjacent the side surface 110 of the panel is provided with a recess 113 which houses a protective strip 112.

Preferably, the first protective strip 112 is coated with tungsten. A tungsten coating protects the first protective strip 112 from damage from power drills directed through the frame 200 or the panel 100. It is envisaged that the first elongate strip 22 will also be tungsten coated.

Referring to FIG. 5 of the drawings, there is shown a securing device 10, for use with inwardly opening double doors, which includes the engaging means 12, the latch engaging means 16, and the dead-latch engaging means as described with reference to FIGS. 1 and 2. The receiving means 14 of the securing device 10 in this embodiment of the invention, however, is mounted on a mounting device 70 as shown in FIGS. 5 and 6 fitted to an opposing door panel 100*a* rather than the door frame 200 as described with reference to FIGS. 1 and 2.

It will be understood that like features will be referred to by like numbers.

The mounting device 70 extends substantially the full length of the opposing door panel 100*a*. The mounting device 70 comprises a first elongate member 72 having a C-shaped profile, a second elongate member 74 having an L-shaped profile and an angled web member 76.

An end portion 74 of the second elongate member 74 remote from a flange portion 75 of the second elongate member 74 is perpendicularly connected along the length of its edge to an inner surface 721 of an intermediate member 722 of the first elongate member 72 such that the flange portion 75 is directed toward a first arm 723 of the first elongate member 72. The second elongate member 74 is spaced at a shorter distance from the first arm 723 of the first elongate member 72 than from a second arm 725 of the first elongate member 72.

An inwardly facing surface 130*a* of the opposing panel 100*a* is provided with a recess 26*a* to house the flange portion 75. A first surface 742 of the second elongate member 74 disposed adjacent to the flange portion 75 is mounted contiguously on a side surface 110*a* of the opposing door panel 100*a*. A free end 724 of the first arm 723 of the first elongate member 72 is contiguous with an outwardly facing surface 120*a* of the door panel 100*a*, the free end 724 being spaced apart from the side surface 120*a* of the opposing door panel 100*a*.

The angled web member 76 extends between the second arm 725 of the first elongate member 72 and a second surface 743 of the second elongate member 74. The apex 761 of the angled web member 76 is directed substantially toward the intermediate member 722 of the first elongate member 72.

The mounting device 70 is provided with a plurality of substantially horizontal gusset members 78, each gusset member 78 being disposed adjacent to opposing ends of the mounting device 70. The gusset members 78 are arranged to extend between an enclosed space defined by the angled web member 76, the first and second elongate members 72, 74.

Each gusset member 78 is provided with an aperture 782. The aperture 782 is arranged to slidably receive a substantially vertically extending pin 79. The pin 79 is slidable between a first extended position as shown in FIG. 6, in which the pin protrudes beyond the opposing ends of the mounting device 70, and a second retracted position as shown in FIG. 5, in which the pin 79 is withdrawn within the mounting device 70.

An outermost end of each pin 79 is arranged to be received in a substantially vertically aligned recess (not shown) disposed in a substantially horizontal upper or lower surface located above the door panels 100, 100*a*. It is envisaged that the upper surface could be an overlying door frame, and the lower surface could be a floor or underlying door frame. When the pin 79 is in the first extended position and it is engaged in the recess, the opposing door panel 100*a* is prevented from pivoting about its hinge. When the pin 79 is in the second retracted position and it is disengaged from the recess, the opposing door panel 100*a* is freely pivotable about its hinge.

Each pin 79 is provided with an outwardly extending handle 77 to facilitate movement of the pin 79 between the first extended position and the second retracted position. The handle 77 is arranged to be received in a corresponding cut out portion 75 disposed in the angled web member 76, at opposing ends of the mounting device 70 as shown in FIG. 6.

The cut out portion 75 is provided with a first recess 752 disposed proximal to the corresponding gusset portion 78, and a second recess 754 spaced remote from the same gusset portion 78. The first and second recesses 752, 754 are arranged to receive the handle 77 to secure the pin 79 in the first extended position and the second retracted position, respectively.

In use, in order to secure a swingable door panel 100 and a corresponding door frame 200 or door panel 100*a* in a secured closed configuration, as shown in FIGS. 2, 4 and 5, the latch means 300 is operated such that the latch 310 is slid into a first retracted position. The second elongate strip 32 of the engaging means 12 is in communication with the latch 310 by virtue of the engagement of the second member 54 of the latch engaging means 16 in the aperture 312 of the latch 310 and thus the second elongate strip 32 is caused to pivot about the hinge portion 30 to the first position.

In the first position, the door panel 100 may be swung freely into a closed position with the door frame 200 without encountering obstruction to its passage from the receiving means 14, particularly the flange portion 48 extending outwardly from the door frame 200.

The latch means 300 is then operated such that the latch 310 is slid into the second extended position. The second elongate strip 32 is caused to pivot about the hinge portion 30 to the second position as shown in FIGS. 2, 4 and 5.

In the second position, the engaging means 12 is received by the receiving means 14. It will be appreciated that any attempt to open the door panel 100 without operating the latch means 300 to slide the latch 310 to a first retracted position will be prevented because the flange portion 48 provides an obstruction to movement of the door panel when the second elongate strip 32 of the engaging means 12 is in the second position. In such an attempt the flange portion 38 of the second elongate strip 32 is pressed against the flange portion 48 of the receiving means 14, the flange portion 48 preventing further passage of the door panel 100 to an open unsecured configuration. The door panel 100 is opened by operating the latch means 300 such that the latch 310 is slid into a first retracted position. The second elongate strip 32 of the engaging means 12 is thus pivoted about the hinge portion 30 to the first position, thereby allowing the door panel 100 to swing freely to an open unsecured configuration.

In a conventional prior art arrangement, the door panel and the door frame typically fit closely together and the latch means is generally positioned adjacent a side surface of the door panel such that a dead latch of the latch means engages with a strike plate located on the door frame.

It will be appreciated that in the arrangement of the present invention, the dead-latch of the latch means 300 is not located where it can engage with the strike plate located on the door frame 200, a substantial gap existing between the strike plate and the dead-latch, as shown in FIGS. 2, 4 and 5.

The dead-latch engaging means 18 is arranged to operate the dead-latch and engage it at the same point and time of closure as would the strike plate in a conventional arrangement.

Furthermore, in the arrangement of the present invention, the door frame 200 is s provided with a primary strike 500 disposed adjacent the flange portion 48 of the receiving means 14. The primary strike 500 is formed from a resilient plastic material, preferably nylon or polyurethane. The purpose of the primary strike is to protect the second elongate strip 32 from scratches and damage from wear. Additionally, the primary strike 500 provides a surface against which the second elongate strip 32 to interacts upon positioning the door panel 100 and the door frame 200 in a closed configuration, thereby mimicking the sensation of closing and locking a conventional door and frame arrangement. The primary strike 500 also minimises the "rattling" effect of the door panel 100 within the door frame 200 which arises as a result of a spatial clearance therebetween.

It will be appreciated that for double doors or French doors comprising a first door panel and a second corresponding door panel, that instead of providing the receiving means 14 on the door frame 200, the receiving means 14 may be positioned on the second door panel. The second door panel may be provided with elongate fixtures arranged to accommodate the receiving means 14. Furthermore, the elongate fixtures may also be arranged to accommodate a protective flashing member positioned over a seam between the first and second door panels to protect the seam from tampering and forced entry.

It will also be appreciated that the receiving means 14 may be mounted on the door panel and the engaging means 12 may be mounted on the door frame.

Modifications and variations as would be apparent to a skilled addressee are deemed to be within the scope of the present invention.

What is claimed is:

1. A securing device for securing a door panel and a complementary door frame housing a latch means in a closed configuration against forced entries, the latch means comprising a latch and a recess to receive the latch in the closed configuration in which the panel and the frame are in an unsecured configuration and a second configuration in which the panel and the frame are in a secured configuration; a primary receiving means for receiving the engaging means in the second configuration; a means for fixedly connecting the engaging means to the latch to enable the engaging means to be communicatively moved between the first and second configurations by sliding the latch between a first retracted position and to a second extended position, respectively; and a secondary receiving means disposed adjacent to the primary receiving means, the secondary receiving means being arranged in use to receive the engaging means in the second configuration upon failure of the primary receiving means.

2. A securing device according to claim 1, wherein the primary receiving means comprises a resilient member arranged in use to be buffeted by the engaging means so as to reduce wear on the engaging means and avoid wear on the receiving means.

3. A securing device according to claim 1, wherein the primary, receiving means comprises a primary strike formed from a resilient material.

4. A securing device according to claim 1, wherein the engaging means is comprised of a first elongate strip hingedly connected to a second elongate strip provided with a first flange portion, the first elongate strip being arranged, in use, to be mounted along a length of the door panel; the primary receiving means being disposed adjacent the secondary receiving means wherein the primary receiving means affords a surface against which the second elongate strip interacts when the engaging means is configured in the second configuration; and the secondary receiving means is comprised of an elongate strip provided with a second flange portion, the elongate strip being arranged, in use, to be mounted along a length of the door frame.

5. A securing device according to claim 4, wherein the engaging means and the second flange portion of the secondary receiving means only interact upon failure or damage of the primary receiving means.

6. A securing device according to claim 4, whereby in the secured configuration the first and second flange portions are spaced laterally from one another.

7. A securing device for an inwardly opening door assembly according to claim 4, wherein in the secured configuration the second elongate strip and the first flange portion are nested within the elongate strip and the second flange portion of the secondary receiving means.

8. A securing device for an outwardly opening door assembly according to claim 4, whereby in the secured configuration the first flange portion of the engaging means is nested within the second flange portion of the secondary receiving means and the door frame.

9. A securing device for a double door assembly according to claim 1, wherein a leading edge of a first door panel is provided with a mounting means, the mounting means being arranged, in use, to provide a static surface for mounting the receiving means thereto.

10. A securing device for a double door assembly according to claim 9, wherein the mounting means is provided with a pair of opposing pins slidable between a first extended position and a second retracted position, the pins being arranged in the first extended position to be received in respective vertically aligned recesses disposed in a horizontal upper or lower surface located above the first door panel, so as to prevent the first door panel from pivoting about its hinge.

11. A securing device according to claim 2, wherein the means for connecting the engaging means to the latch comprises a transversely disposed stepped rectilinear member mounted on the second elongate strip of the engaging means, wherein a portion of the rectilinear member overhangs the second elongate strip, the overhanging portion being arranged, in use, to be received in an aperture in the latch.

12. A securing device according to claim 11, wherein the means for connecting the engaging means to the latch comprises a transversely disposed stepped rectilinear member mounted on -the second elongate strip of the engaging means, wherein a portion of the rectilinear member overhangs the second elongate strip, the overhanging portion being arranged, in use, to be received in an aperture in the latch.

13. A securing device according to claim 1, wherein the door panel and the complementary door frame further house a dead latch means, the securing device further comprising a means to engage the dead latch means in the second configuration.

14. A securing device according to claim 13, wherein the means to engage the dead latch means comprises a striker, the striker being arranged, in use, to engage the dead latch means when the engaging means is in the second configuration.

* * * * *